US012158018B2

(12) United States Patent
Smith

(10) Patent No.: US 12,158,018 B2
(45) Date of Patent: Dec. 3, 2024

(54) SELECTIVELY DEPLOYABLE SCREENING ASSEMBLY AND METHOD OF USE

(71) Applicant: Leslee Smith, Marietta, GA (US)

(72) Inventor: Leslee Smith, Marietta, GA (US)

( * ) Notice: Subject to any disclaimer, the term of this patent is extended or adjusted under 35 U.S.C. 154(b) by 366 days.

(21) Appl. No.: 17/752,993

(22) Filed: May 25, 2022

(65) Prior Publication Data

US 2023/0407671 A1 Dec. 21, 2023

(51) Int. Cl.
*E04H 17/18* (2006.01)
*E04H 17/16* (2006.01)

(52) U.S. Cl.
CPC ..... *E04H 17/18* (2013.01); *E04H 17/1602* (2021.01)

(58) Field of Classification Search
CPC ..... E01F 7/00; E04H 17/1602
See application file for complete search history.

(56) References Cited

U.S. PATENT DOCUMENTS 2,981,256 A * 4/1961 Besnah ..... A47C 31/00 135/93
4,077,418 A * 3/1978 Cohen ..... E04H 15/48 135/95
4,124,196 A 11/1978 Hipskind
4,186,912 A 2/1980 Byrd, Jr.
5,054,507 A * 10/1991 Sparks ..... E04H 15/003 135/97
6,036,249 A 3/2000 Kuntz
7,600,554 B1 10/2009 Wright
7,874,090 B2 * 1/2011 Flagg ..... G09F 15/0068 211/175
D670,921 S 11/2012 Goranson
8,973,645 B1 3/2015 Cannova
9,908,465 B2 3/2018 Allison
10,794,113 B2 * 10/2020 Tapley ..... E06B 9/24
2010/0288450 A1 * 11/2010 Bruck ..... F16M 11/242 248/176.1
2016/0143453 A1 * 5/2016 Shapiro ..... A47D 13/063 256/25

FOREIGN PATENT DOCUMENTS

CA 2502994 A1 * 9/2005 ..... E04H 15/48
EP 1225280 1/2002
FR 2406695 A1 * 5/1979 ..... E01F 7/00

* cited by examiner

*Primary Examiner* — Matthew R McMahon

(57) ABSTRACT

A selectively deployable screening assembly for screening an event from being viewed by passersby includes a set of shielding devices, the shielding devices of which are selectively mutually couplable. Each shielding device comprises a frame, a panel, and a base. The frame comprises a lower element and a pair of side elements, each of which is hinged and foldable. The side elements also are foldable into substantial abutment with the lower element. The panel, which is substantially opaque, is attached to and extends between the lower element and the side elements. The base is attached to the lower element and stabilizes the frame on a surface. The set of shielding devices is deployable proximate to a perimeter of a site of an event, such as an accident, a crime scene, and the like, to screen the event from being viewed by passersby.

15 Claims, 10 Drawing Sheets

SELECTIVELY DEPLOYABLE SCREENING ASSEMBLY AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to screening assemblies and more particularly pertains to a new screening assembly for screening an event from being viewed by passersby. The present invention discloses a screening assembly comprising a set of selectively mutually couplable shielding devices, each of which comprises a foldable frame, a panel, and a base, which is useful in screening an event from being viewed by passersby.

(2) Description of Related Art Including Information Disclosed Under 37 CFR 1.97 and 1.98

The prior art relates to screening assemblies. Prior art screening assemblies may comprise pairs of trailers with screens that extend between the trailers, roller screens that are akin to horizontally deployable window shades, and screens that are secured between extensible posts, which may have tripodal bases, by means of cables, couplers, and the like. Prior art screening assemblies also may comprise inflatable screens, and screening assemblies that comprise primary screens that extend between extensible posts and secondary screens that are selectively attachable to the extensible posts and the primary screens to increase overall heights of the screening assemblies. Prior art screening assemblies also may comprise screening assemblies that have vertically foldable frames that are rollable, or rectangular foldable frames to which screens and weighted bases are attachable. What is lacking in the prior art screening assembly comprising a set of selectively mutually couplable shielding devices, each of which comprises a foldable frame, a panel, and a base. The panel, which is substantially opaque, is attached to and extends between the lower element and the side elements. The base is attached to the lower element and stabilizes the frame on a surface.

BRIEF SUMMARY OF THE INVENTION

An embodiment of the disclosure meets the needs presented above by generally comprising a set of shielding devices, the shielding devices of which are selectively mutually couplable. Each shielding device comprises a frame, a panel, and a base. The frame comprises a lower element and a pair of side elements. The lower element comprises a pair of segments, which are mutually hingedly attached so that said lower element is foldable. Each side element is hingedly attached to a respective opposed end of the lower element and is foldable into substantial abutment with the lower element. The side element comprises a pair of sections, which are mutually hingedly attached so that the side element is foldable. The panel, which is substantially opaque, is attached to and extends between the lower element and the pair of side elements. The base is attached to the lower element and is configured to stabilize the frame on a surface, with the frame being substantially perpendicular to the surface. The set of shielding devices is configured for deployment proximate to a perimeter of a site of an event, such as an accident, a crime scene, and the like, to screen the event from being viewed by passersby.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
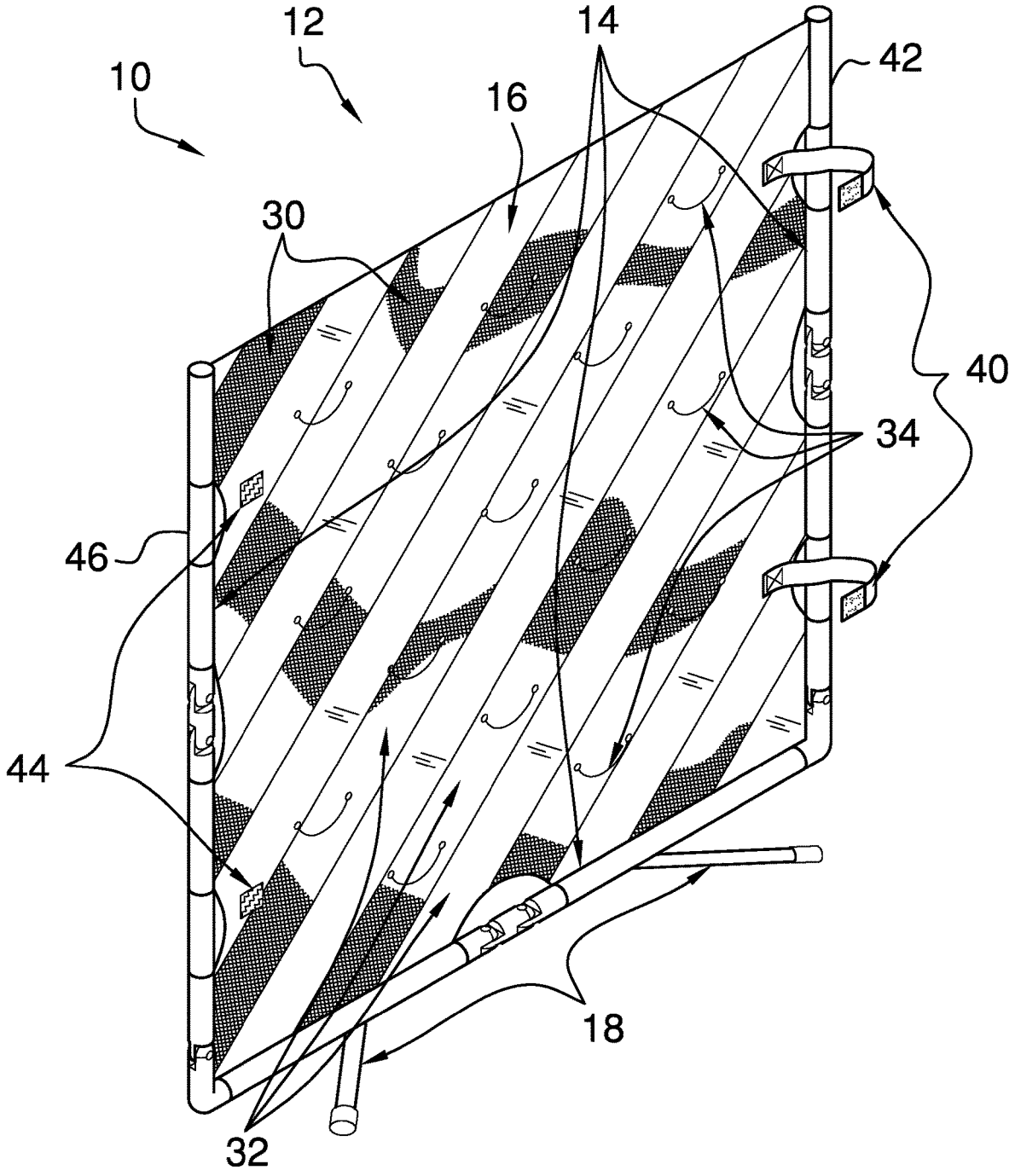
FIG. 1 is an isometric perspective view of a selectively deployable screening assembly according to an embodiment of the disclosure.

With reference now to the drawings, and in particular to FIGS. 1 through 11 thereof, a new screening assembly embodying the principles and concepts of an embodiment of the disclosure and generally designated by the reference numeral 10 will be described.

As best illustrated in FIGS. 1 through 11, the selectively deployable screening assembly 10 generally comprises a set of shielding devices 12, the shielding devices 12 of which are selectively mutually couplable. Each shielding device 12 comprises a frame 14, a panel 16, and a base 18. The frame 14 comprises a lower element 20 and a pair of side elements 22. The lower element 20 comprises a pair of segments 24, which are mutually hingedly attached so that said lower element 20 is foldable. Each side element 22 is hingedly attached to a respective opposed end 26 of the lower element 20 and is foldable into substantial abutment with the lower element 20. The side element 22 comprises a pair of sections 28, which are mutually hingedly attached so that the side element 22 is foldable.

Figure 2:
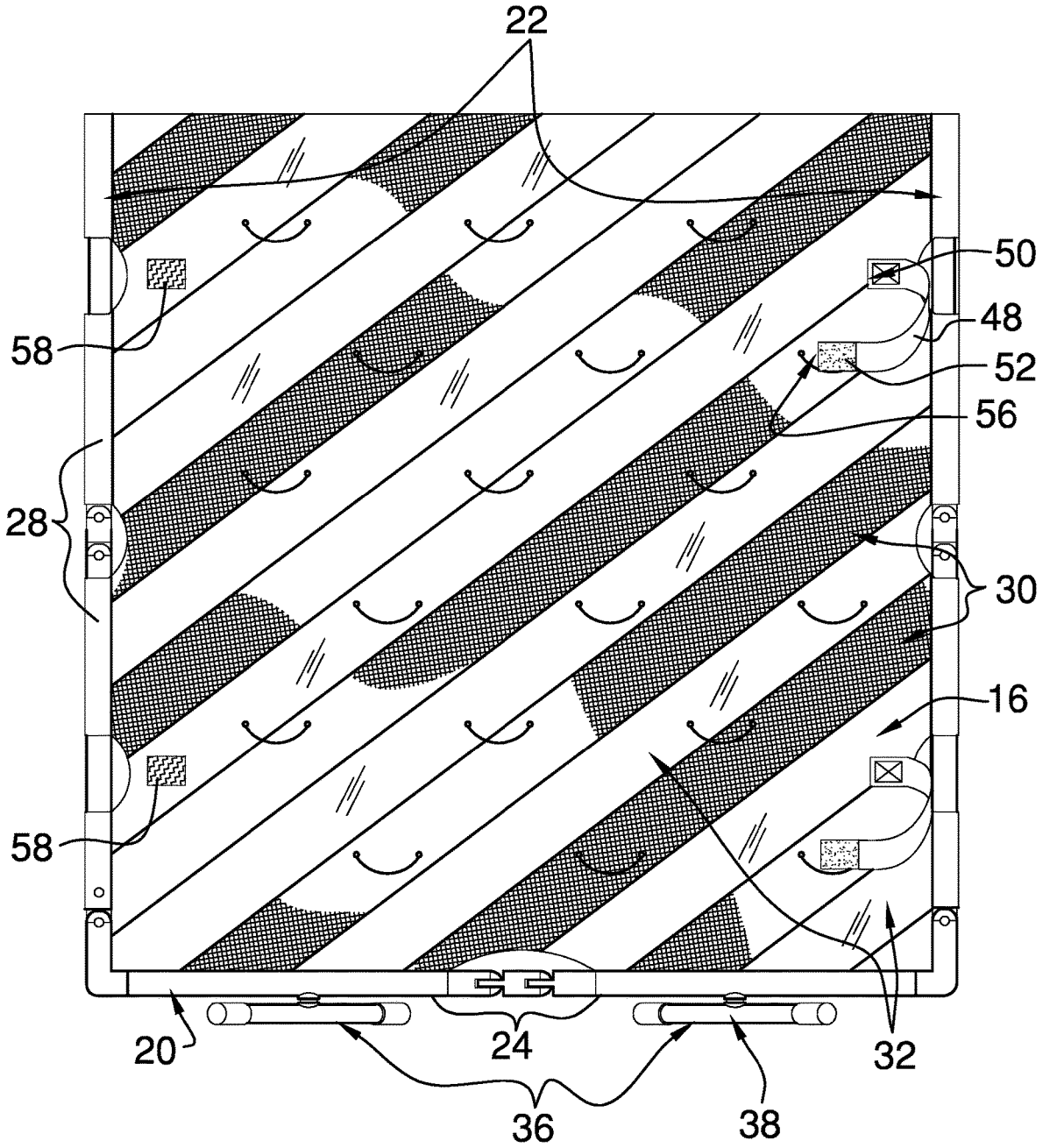
FIG. 2 is a front view of an embodiment of the disclosure.
Figure 3:
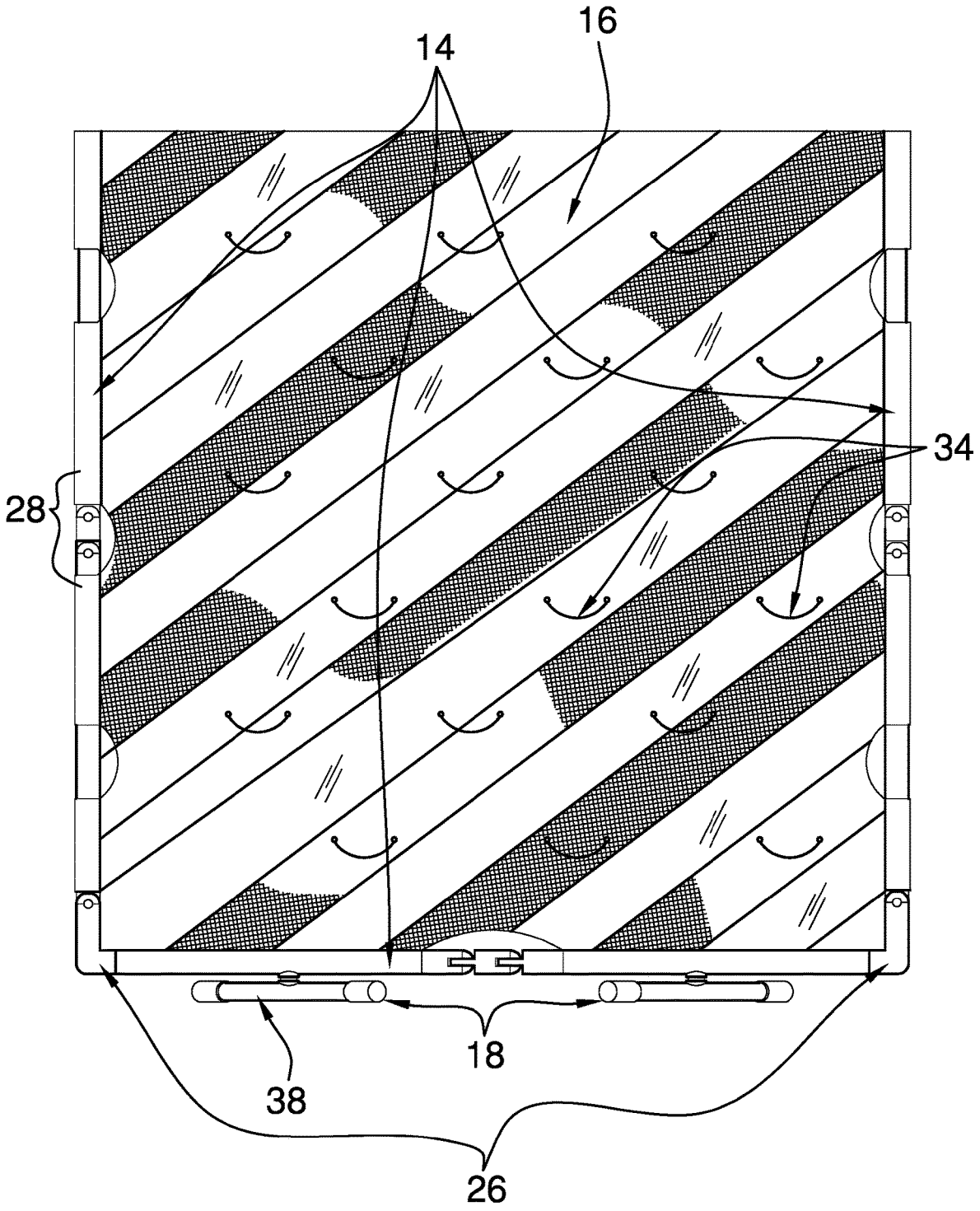
FIG. 3 is a rear view of an embodiment of the disclosure.

The panel 16, which is substantially opaque, is attached to and extends between the lower element 20 and the pair of side elements 22. As shown in FIG. 2, the panel 16 comprises a plurality of meshed sections 30 and a plurality of reflective sections 32. The meshed sections 30 allow passage of air through the panel 16 and also allow for a person, such as a first responder, who is positioned close to the panel 16 to see through the panel 16. The reflective sections 32 render the panel 16 highly visible and increase safety relative to warning triangles that typically are placed proximate to sites of accidents. A plurality of slits 34 is positioned in the panel 16 and is configured to allow for passage of air through the panel 16 to reduce a risk of wind tipping the shielding device 12.

Figure 4:
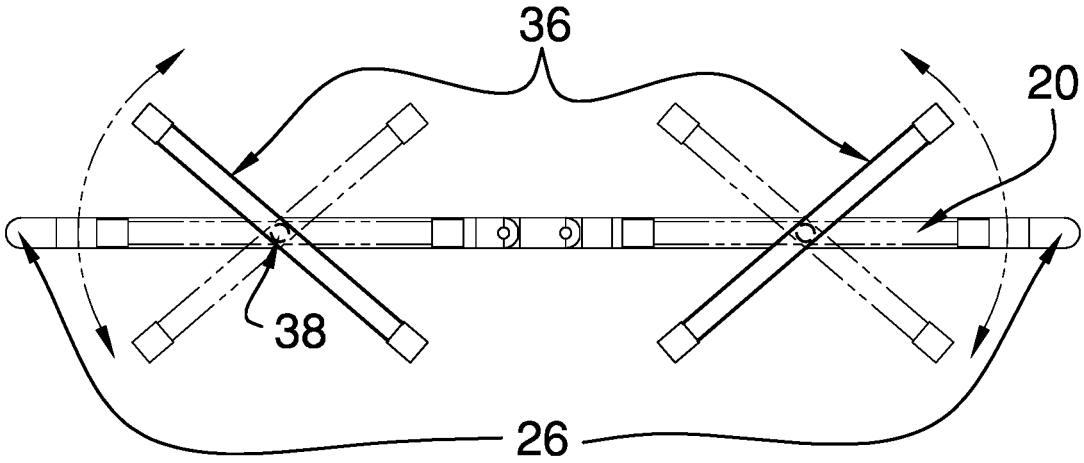
FIG. 4 is a bottom view of an embodiment of the disclosure.
Figure 5:
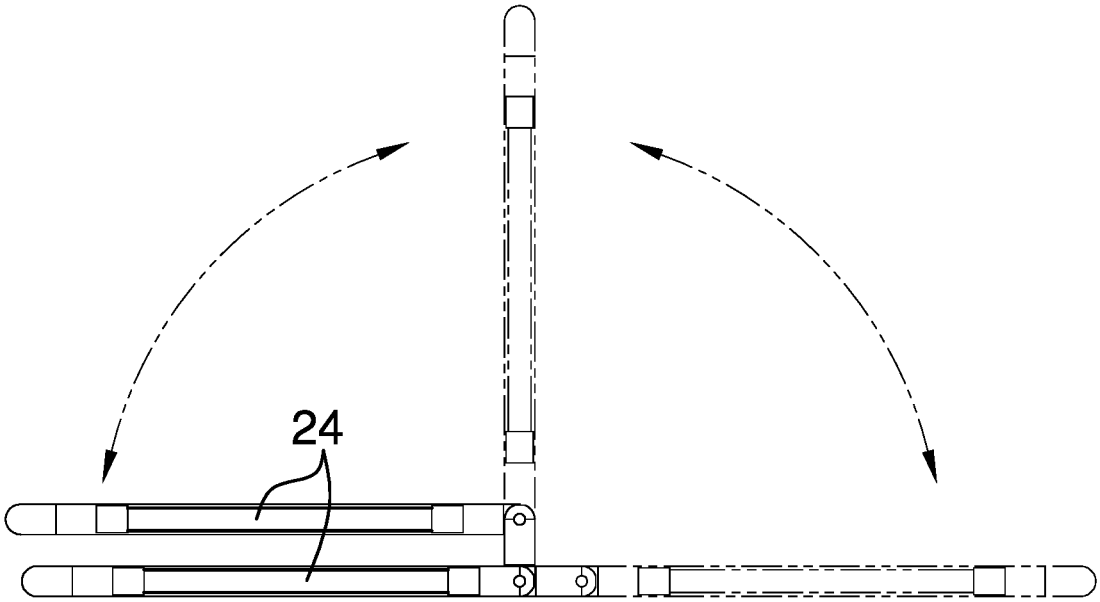
FIG. 5 is a bottom view of an embodiment of the disclosure.
Figure 6:
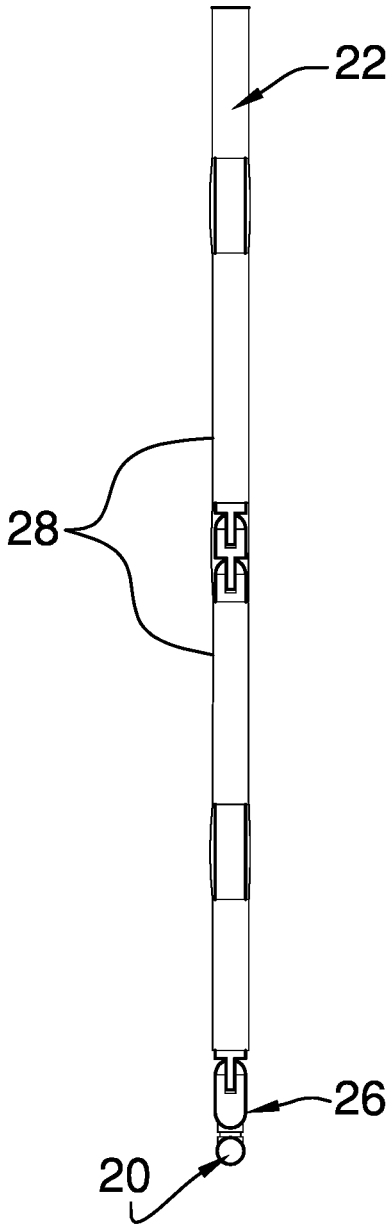
FIG. 6 is a side view of an embodiment of the disclosure.
Figure 7:
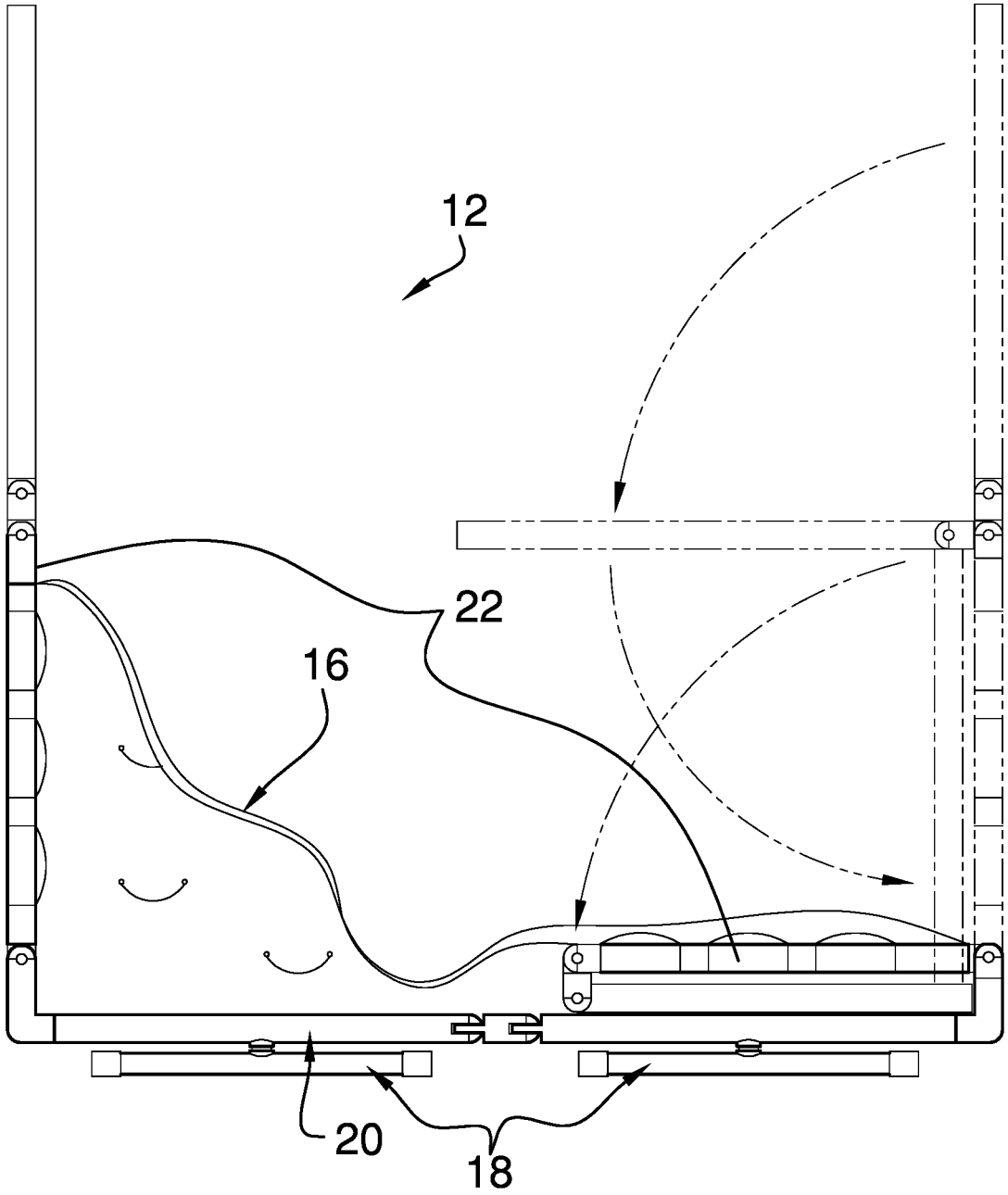
FIG. 7 is a front view of an embodiment of the disclosure.

The base 18 is attached to the lower element 20 and is configured to stabilize the frame 14 on a surface, with the frame 14 being substantially perpendicular to the surface. As shown in FIG. 4, the base 18 comprises a pair of arms 36. Each arm 36 is rotationally coupled, proximate to a midpoint 38 of the arm 36, to the lower element 20. To deploy the base 18, the arms 36 simply are rotated relative to the lower element 20 of the frame 14.

The set of shielding devices 12 is configured for deployment proximate to a perimeter of a site of an event, such as an accident, a crime scene, and the like, to screen the event from being viewed by passersby. Such events typically distract passersby, such as drivers and pedestrians, leading to backups, additional accidents, and a lack of privacy for those involved with the event. The selectively deployable screening assembly 10 can be used in any situation wherein additional privacy or temporary barrier is desired.

Figure 8:
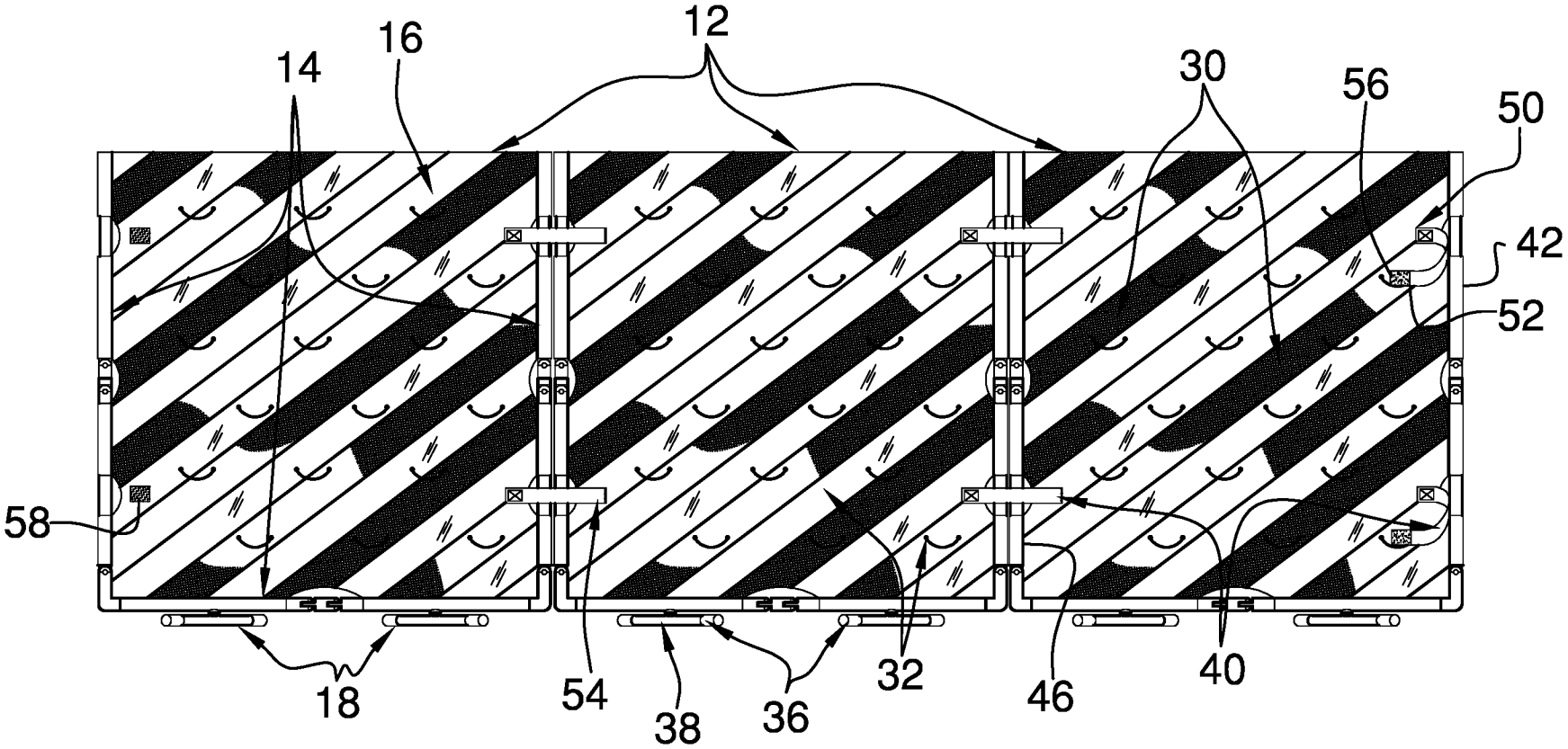
FIG. 8 is a front view of an embodiment of the disclosure.
Figure 9:
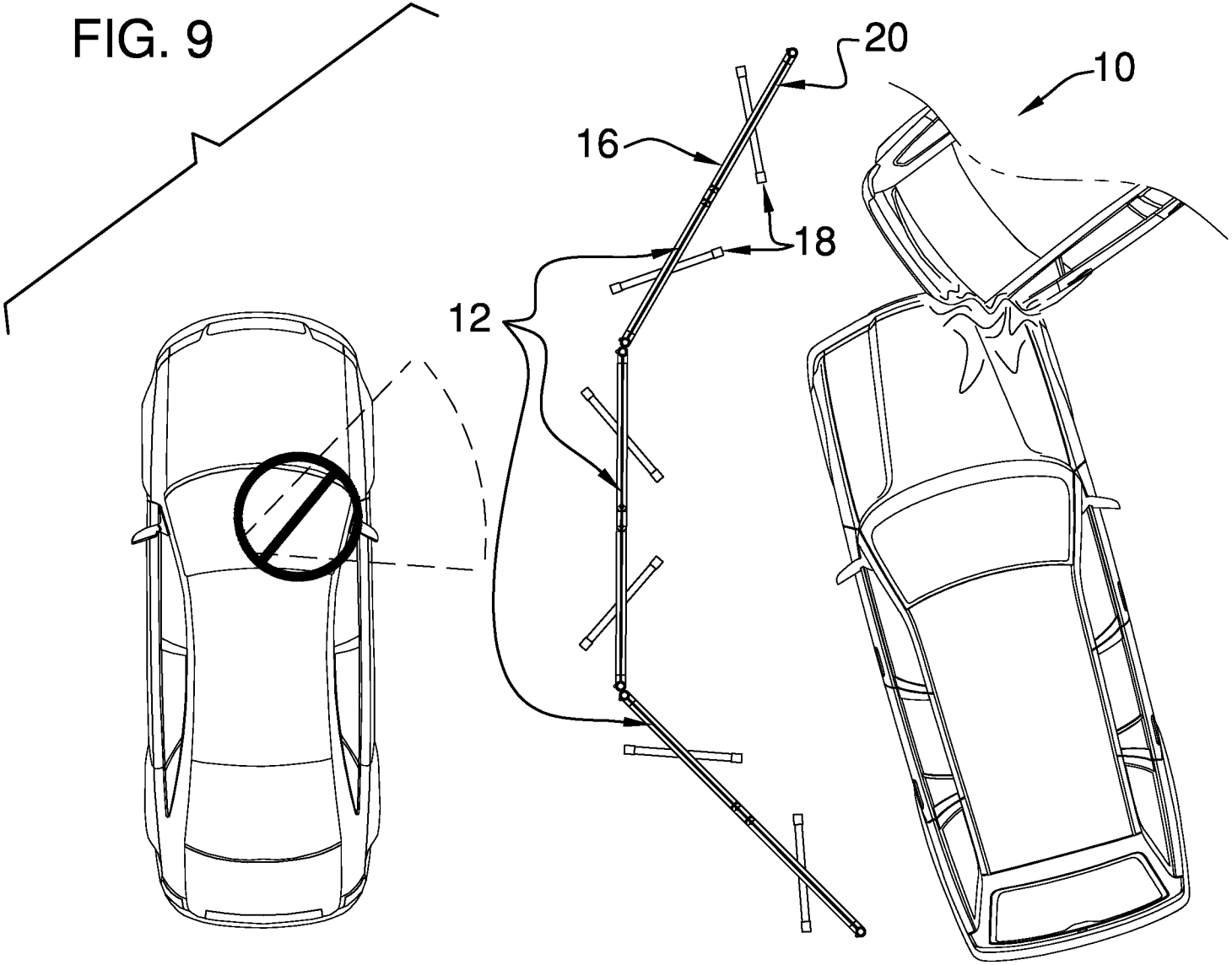
FIG. 9 is an in-use of an embodiment of the disclosure.

Each of a plurality of first fasteners 40 is attached to a respective shielding device 12 proximate to a first side element 42 of the respective shielding device 12. Each of a plurality of second fasteners 44, which are complementary to the first fasteners 40, is attached to a respective shielding device 12 proximate to a second side element 46 of the respective shielding device 12. As shown in FIG. 8, each second fastener 44 is positioned to selectively fasten to a respective first fastener 40 to removably attach the shielding devices 12 together. The respective first fastener 40 may comprise a strap 48, a first end 50 of which is attached to the respective shielding device 12. A first element 52 of a hook and loop connector 54 is attached to the strap 48 proximate to a second end 56 of the strap 48. The second fastener 44 comprises a second element 58 of the hook and loop connector 54. The respective first fastener 40 and the second fastener 44 also may comprise other fastening means, such as, but not limited to, clamps, bungee cords, and the like.

Figure 10:
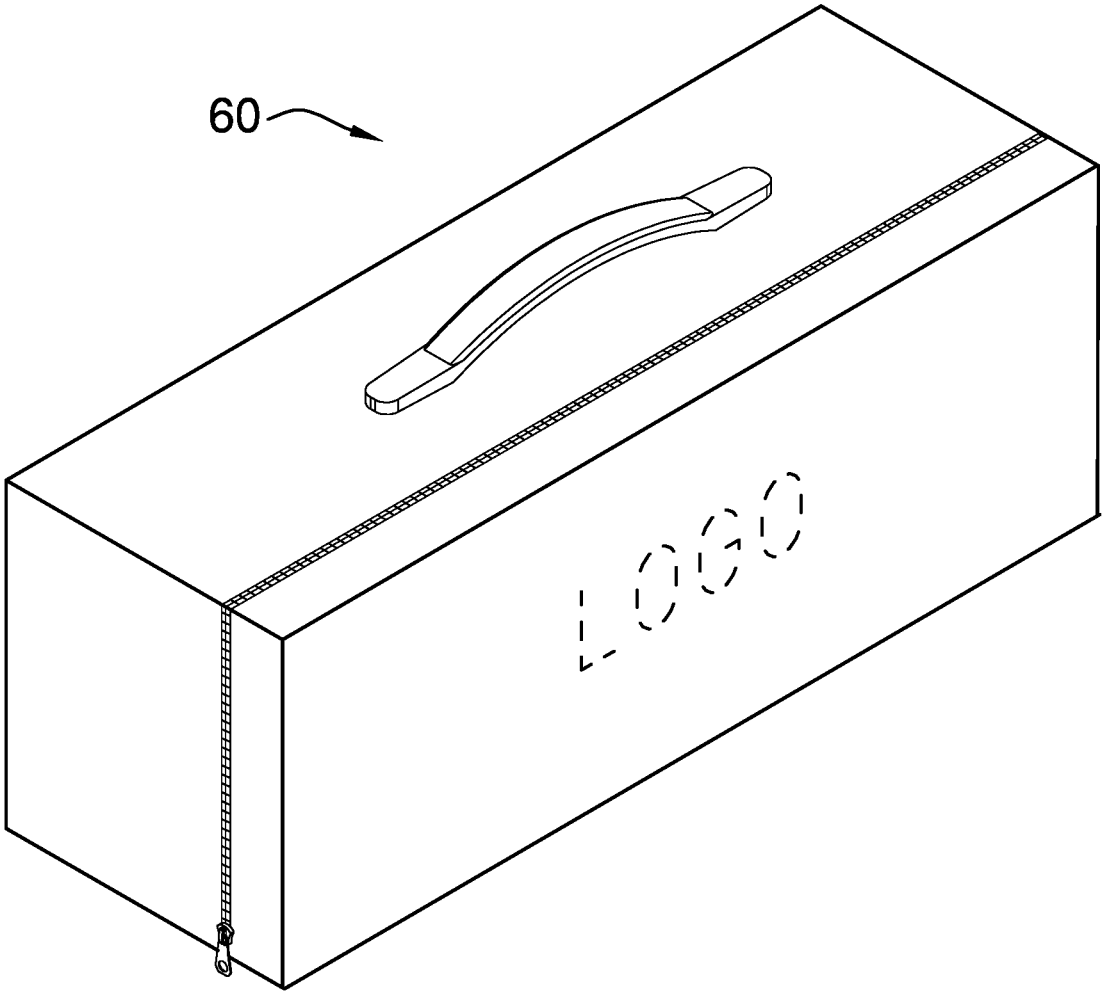
FIG. 10 is an isometric perspective view of an embodiment of the disclosure.
Figure 11:
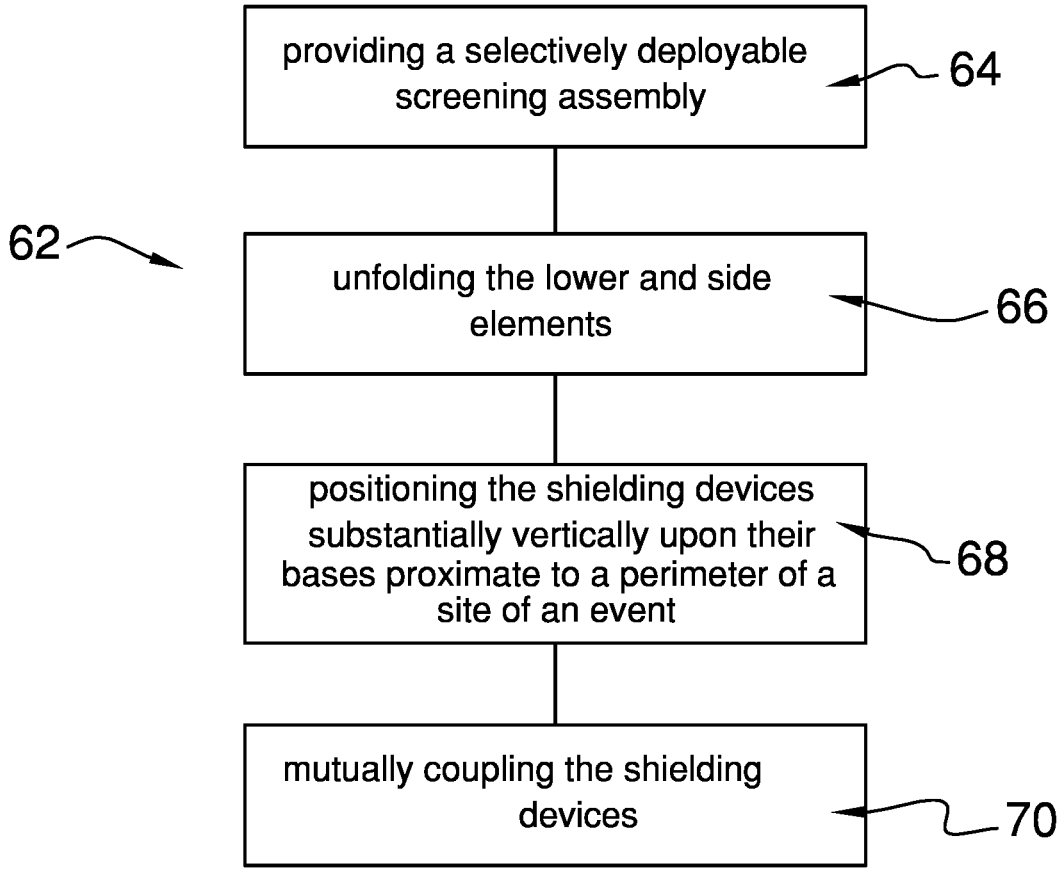
FIG. 11 is a schematic view of a method for an embodiment of the disclosure.

The selectively deployable screening assembly 10 also may comprise a carrying case 60, as shown in FIG. 10, which is sized to contain at least one shielding device 12.

The selectively deployable screening assembly 10 enables a method of screening an event from being viewed by passersby 62. The method 62 comprises a first step 64 of providing a selectively deployable screening assembly 10 according to the specification above. A second step 66 of the method 62 is unfolding the lower element 20 and the side elements 22 of each shielding device 12. A third step 68 of the method 62 is positioning the shielding devices 12 substantially vertically upon their bases 18 proximate to a perimeter of a site of an event. A fourth step 70 of the method 62 is mutually coupling the shielding devices 12 of the set of shielding devices 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A selectively deployable screening assembly comprising a set of shielding devices, the shielding devices being selectively mutually couplable, each shielding device comprising:

a frame comprising:

a lower element comprising a pair of segments, the segments being mutually hingedly attached, such that said lower element is foldable, and a pair of side elements, each side element being hingedly attached to a respective opposed end of the lower element, such that each side element is foldable into substantial abutment with the lower element, each side element comprising a pair of sections, the sections being mutually hingedly attached, such that each side element is foldable;

a panel attached to and extending between the lower element and the pair of side elements, the panel being substantially opaque;

wherein each side element has a free distal end relative to the lower element such that the frame extends only around a bottom edge and opposed side edges of the panel when the frame is fully deployed;

a base attached to the lower element and being configured for stabilizing the frame on a surface, such that the frame is substantially perpendicular to the surface; and wherein the set of shielding devices is configured for deployment proximate to a perimeter of a site of an event for screening the event from being viewed by passersby.

2. The selectively deployable screening assembly of claim 1, wherein the panel comprises a plurality of meshed sections and a plurality of reflective sections.

3. The selectively deployable screening assembly of claim 1, wherein the base comprises a pair of arms, each arm being rotationally coupled, proximate to a midpoint of the arm, to the lower element.

4. The selectively deployable screening assembly of claim 1, further including:

a plurality of first fasteners, each first fastener being attached to a respective shielding device proximate to a first side element of the respective shielding device; and a plurality of second fasteners, each second fastener being attached to a respective shielding device proximate to a second side element of the respective shielding device, the second fasteners being complementary to the first fasteners, such that each second fastener is positioned for selectively fastening to a respective first fastener for removably attaching the shielding devices together.

5. The selectively deployable screening assembly of claim 4, wherein:

each respective first fastener comprises:

a strap, a first end of the strap being attached to the respective shielding device, and a first element of a hook and loop connector attached to the strap proximate to a second end of the strap; and each respective second fastener comprises a second element of the hook and loop connector.

6. The selectively deployable screening assembly of claim 1, further including a plurality of slits positioned in the panel, wherein the slits are configured for passing of air through the panel for reducing a risk of wind tipping the shielding device.

7. The selectively deployable screening assembly of claim 1, further including a carrying case sized to contain at least one shielding device.

8. A method of screening an event from being viewed by passersby, the method comprising the steps of:

providing a selectively deployable screening assembly comprising a set of shielding devices, the shielding devices being selectively mutually couplable, each shielding device comprising:

a frame comprising:

a lower element comprising a pair of segments, the segments being mutually hingedly attached, such that said lower element is foldable, and a pair of side elements, each side element being hingedly attached to a respective opposed end of the lower element, such that each side element is foldable into substantial abutment with the lower element, each side element comprising a pair of sections, the sections being mutually hingedly attached, such that each side element is foldable, a panel attached to and extending between the lower element and the pair of side elements, the panel being substantially opaque, wherein each side element has a free distal end relative to the lower element such that the frame extends only around a bottom edge and opposed side edges of the panel when the frame is fully deployed, a base attached to the lower element and being configured for stabilizing the frame on a surface, such that the frame is substantially perpendicular to the surface, and wherein the set of shielding devices is configured for deployment proximate to a perimeter of a site of an event for screening the event from being viewed by passersby;

unfolding the lower element and the side elements of each shielding device;

positioning the shielding devices substantially vertically upon their bases proximate to a perimeter of a site of an event; and mutually coupling the shielding devices of the set of shielding devices.

9. The method of claim 8, wherein the panel comprises a plurality of meshed sections and a plurality of reflective sections.

10. The method of claim 8, wherein the base comprises a pair of arms, each arm being rotationally coupled, proximate to a midpoint of the arm, to the lower element.

11. The method of claim 8, further including:

a plurality of first fasteners, each first fastener being attached to a respective shielding device proximate to a first side element of the respective shielding device; and a plurality of second fasteners, each second fastener being attached to a respective shielding device proximate to a second side element of the respective shielding device, the second fasteners being complementary to the first fasteners, such that each second fastener is positioned for selectively fastening to a respective first fastener for removably attaching the shielding devices together.

12. The method claim 11, wherein:

each respective first fastener comprises:

a strap, a first end of the strap being attached to the respective shielding device, and a first element of a hook and loop connector attached to the strap proximate to a second end of the strap; and each respective second fastener comprises a second element of the hook and loop connector.

13. The method of claim 8, further including a plurality of slits positioned in the panel, wherein the slits are configured for passing of air through the panel for reducing a risk of wind tipping the shielding device.

14. A selectively deployable screening assembly comprising a set of shielding devices, the shielding devices being selectively mutually couplable, each shielding device comprising:

a frame comprising:

a lower element comprising a pair of segments, the segments being mutually hingedly attached, such that said lower element is foldable, and a pair of side elements, each side element being hingedly attached to a respective opposed end of the lower element, such that each side element is foldable into substantial abutment with the lower element, each side element comprising a pair of sections, the sections being mutually hingedly attached, such that each side element is foldable;

a panel attached to and extending between the lower element and the pair of side elements, the panel being substantially opaque, the panel comprising a plurality of meshed sections and a plurality of reflective sections;

wherein each side element has a free distal end relative to the lower element such that the frame extends only around a bottom edge and opposed side edges of the panel when the frame is fully deployed;

a base attached to the lower element and being configured for stabilizing the frame on a surface, such that the frame is substantially perpendicular to the surface, wherein the set of shielding devices is configured for deployment proximate to a perimeter of a site of an event, for screening the event from being viewed by passersby, the base comprising a pair of arms, each arm being rotationally coupled, proximate to a midpoint of the arm, to the lower element;

a plurality of first fasteners, each first fastener being attached to a respective shielding device proximate to a first side element of the respective shielding device;

a plurality of second fasteners, each second fastener being attached to a respective shielding device proximate to a second side element of the respective shielding device, the second fasteners being complementary to the first fasteners, such that each second fastener is positioned for selectively fastening to a respective first fastener for removably attaching the shielding devices together, each respective first fastener comprising:

a strap, a first end of the strap being attached to the respective shielding device, and a first element of a hook and loop connector being attached to the strap proximate to a second end of the strap, each respective second fastener comprising a second element of the hook and loop connector; and a plurality of slits positioned in the panel, wherein the slits are configured for passing of air through the panel for reducing a risk of wind tipping the shielding device.

15. The selectively deployable screening assembly of claim 14 further including a carrying case sized to contain at least one shielding device.

* * * * *